United States Patent [19]

Isozumi

[11] Patent Number: 4,923,229

[45] Date of Patent: May 8, 1990

[54] COAXIAL TYPE STARTER DEVICE

[75] Inventor: Shuzoo Isozumi, Himeji, Japan

[73] Assignee: Mitsubishi Denki Kabushiki Kaisha, Tokyo, Japan

[21] Appl. No.: 293,857

[22] Filed: Jan. 5, 1989

[30] Foreign Application Priority Data

Feb. 5, 1988 [JP] Japan ..... 63-026014
Mar. 24, 1988 [JP] Japan ..... 63-070233

[51] Int. Cl.[5] ..... F02N 15/06

[52] U.S. Cl. ..... 290/48; 74/7 C; 74/7 E

[58] Field of Search ..... 290/38 R, 48; 74/7 R, 74/7 A, 7 C, 7 E

[56] References Cited

U.S. PATENT DOCUMENTS

| | | | |
|---|---|---|---|
| 4,525,632 | 6/1985 | Tanaka | 290/38 R |
| 4,760,274 | 7/1988 | Isozumi | 290/48 |
| 4,800,766 | 1/1989 | Isozumi et al. | 74/7 E |
| 4,825,095 | 4/1989 | Morishita et al. | 290/48 |
| 4,852,417 | 8/1989 | Tanaka | 74/7 C X |

FOREIGN PATENT DOCUMENTS 1311876 11/1962 France .

*Primary Examiner*—A. D. Pellinen
*Assistant Examiner*—W. E. Duncanson, Jr.
*Attorney, Agent, or Firm*—Sughrue, Mion, Zinn, Macpeak and Seas

[57] ABSTRACT

A coaxial type starter with an overrunning clutch device has a clutch inner member which is provided with a cylindrical portion formed integrally therewith and extended forwardly; is rotatably supported by first and second bearings spaced apart in the axial direction so that they bear the cylindrical portion; and has a helical spline at the inner circumferential surface so as to be engaged with a helical spline formed at the outer circumferential surface of an output rotary shaft inserted in the clutch inner member so that a rotating force by the armature rotary shaft is transmitted to the output shaft. Or, in the coaxial type starter device, a carrier of the planet gear wheel speed-reducing device is formed integrally with a clutch outer member of the overrunning clutch device; the carrier is supported by a first bearing mounted on the front end portion of the armature rotary shaft; and the clutch outer member is supported by a second bearing fitted to a clutch inner member at a position adjacent to the front end of a roller in the overrunning clutch device.

5 Claims, 3 Drawing Sheets

COAXIAL TYPE STARTER DEVICE

BACKGROUND OF THE INVENTION

1. Field of the Invention

The present invention relates to a coaxial type starter device. More particularly, it relates to a coaxial type starter device used for starting the engine of an automobile.

2. Discussion of Background

Heretofore, a conventional starter device used for starting the engine of an automobile is of a so called biaxial structure wherein an electromagnetic switch device for feeding power to a d.c. motor is disposed at the side of the d.c. motor.

However, such biaxial type starter device gave a great restriction when an engine for an automobile is to be designed.

There has been a proposal to make the shape of a starter device simple. According to the proposal, the starter device is so constructed that it has a generally elongated cylindrical form by arranging an electromagnetic switch device at an end in the axial direction of a d.c. motor.

The proposed starter device is illustrated in FIG. 3. In FIG. 3, a coaxial type starter device 1 is such that an armature rotary shaft 3 of a d.c. motor 2 is hollow; a plunger rod 4*a* of an electromagnetic switch device 4 disposed at the rear end of the d.c. motor 2 is extended in the inner passage 3*a* of the hollow armature rotary shaft 3; and an output rotary shaft 5 is inserted in the armature rotary shaft 3 in a coaxial manner so that the rear end of the output rotary shaft 5 is in contact with the free end of the plunger rod 4*a*, whereby when the electromagnetic switch device is actuated, the output rotary shaft 5 is pushed forwardly by means of the plunger rod 4*a*.

A sun gear wheel 6*a* is formed in the outer circumferential portion of the front end of the armature rotary shaft 3, and a plurality of planet gear wheels 6*b* are interlocked with the sun gear wheel 6*a*. The planet gear wheels 6*b* are also interlocked with an internal gear wheel 6*c* formed in the inner circumferential surface of a machine frame 7, and each of the planet gear wheels 6*b* is supported by a carrier 6*e* by means of each shaft 6*d*. The sun gear wheel 6*a*, the planet gear wheels 6*b*, the internal gear wheel 6*c*, the shafts 6*d* and the carrier 6*e* constitute a planet gear speed-reducing device 6 which reduces a rotating speed of the armature rotary shaft 3.

An overrunning clutch device 8 is fitted to the output rotary shaft 5. A clutch inner member 8*a* of the overrunning clutch device 8 is interlocked with a helical spline 5*b* formed in a spline forming section 5*a* of the output rotary shaft 5, the spline forming section 5*a* having an outer diameter greater than the inner diameter of the inner passage 3*a* of the hollow armature rotary shaft 3, whereby the output rotary shaft 5 can receive a rotating force from the clutch inner member 8*a* and is slidable in its axial direction. A pinion 9 is attached to the front end of the output rotary shaft 5 so as to be engaged with and disengaged from a ring gear of an engine (not shown). When the output rotary shaft 5 is caused to slide forwardly, the pinion 9 is engaged with the ring gear to rotate it.

However, in the coaxial type starter device having the construction described above, when the output rotary shaft 5 is pushed forwardly (in the right in FIG. 3) upon actuating the electromagnetic switch device 4, the output rotary shaft 5 is brought such a state that it is supported in a cantilever form by a bearing metal 10 disposed in the inner passage 3*a* of the armature rotary shaft 3 at its rear part of the output rotary shaft 5. Accordingly, an abnormally heavy load may be applied to the output rotary shaft 5 at the time of interlocking of the pinion with the ring gear of the engine, whereby the output rotary shaft 5 is deflected. On the other hand, since the clutch inner member 8*a* of the overrunning clutch device 8 which is interlocked with the output rotary shaft 5 by means of the helical spline is supported at its front end portion by a single bearing 11, the helical spline teeth 5*b* formed at the outer circumferential portion of the rotary shaft 5 so as to extend in the axial direction, the helical spline teeth 5*b* having a shorter length, comes in contact with a cut end of the helical spline groove formed in the inner circumferential surface of the clutch inner member 8*a* in the vicinity of the bearing 11 when the output rotary shaft is pushed forwardly. In this case, there is no supporting member at the rear part and inside the clutch inner member 8*a*. As a result, the deflection of the output rotary shaft 5 causes the deflection of the clutch inner member 8*a*, and the axial center line of revolution of the carrier 6*a* which is formed integrally with the clutch outer member 8*b* does not become in coincidence with the axial center of the armature rotary shaft 3.

In this case, for instance, when the starter device is rotated at a high speed by receiving a reverse driving force of the engine or when the engine or the starter device is in an idling operation, and if the pinion of the starter device is engaged with the ring gear of the engine by turnning on the key switch of the automobile, this resulting a large shock to the device, the planet gear wheel 6*b* may be broken or may generate abnormal sounds. It is serious when the bearing metal 10 becomes worn.

In the conventional starter device, the front end portion of the york 2*a* of the d.c. motor 2 is bent inwardly to form an intermediate bracket 2*b*. The inner edge portion of the intermediate bracket 2 is further bent inwardly (on the side of the armature), i.e. it is bent along the axial line of the armature rotary shaft to thereby form a bearing supporting portion 2*c*. A needle bearing 2*d* is mounted on the bearing supporting portion 2*c* to thereby support the front end of the armature rotary shaft 3. In FIG. 3, a reference numeral 2*e* designates magnetic poles in the d.c. motor 2.

However, in the above-mentioned coaxial type starter device, the bearing supporting portion 2*c* of the intermediate bracket 2*b* interferes in a magnetic pole fitting jig when a magnetic pole is fitted to the york 2*a*. Therefore, it was necessary to place the magnetic pole at the rear part in the axial direction with respect to the bearing supporing portion 2*c*. This necessitates that the entire length of the motor should be large in order to obtain a predetermined torque.

SUMMARY OF THE INVENTION

It is an object of the present invention to provide a coaxial type starter device in which a clutch inner member in an overrunning clutch device is not adversely influenced by the deflection of an output rotary shaft when a pinion is engaged with a ring gear of an engine, whereby occurrence of breakage or generation of abnormal sounds in a planet gear wheel speed-reducing device is avoidable.

It is another object of the present invention to provide a coaxial type starter device with a motor of reduced size and high performance, which assures that the axial lines of the planet gear wheel speed-reducing device and the overrunning clutch device are in alignment with the axial line of the armatrure rotary shaft.

In accordance with the present invention, there is provided a coaxial type starter device which comprises a d.c. motor having a hollow armature rotary shaft, an electromagnetic switch attached to an end of the d.c. motor so that a plunger rod of the electromagnetic switch extends in the hollow armature shaft in a coaxial manner, an output rotary shaft arranged in alignment with the armature rotary shaft so as to be slidable in its axial direction and to be rotated by the armature rotary shaft by means of a planet gear wheel speed-reducing device, and an overrunning clutch device, the output rotary shaft being provided with a pinion at its front end, wherein the overrunning clutch device has a clutch inner member which is provided with a cylindrical portion formed integrally therewith and extended forwardly; is rotatably supported by means of first and second bearings spaced apart in the axial direction so that they bear the cylindrical portion; and has a helical spline at the inner circumferential surface so as to be engaged with a helical spline formed at the outer circumferential surface of the output rotary shaft inserted in the clutch inner member so that a rotating force by the armature rotary shaft is transmitted to the same.

In accordance with the present invention, there is provided a coaxial type starter device which comprises a d.c. motor having a hollow armature rotary shaft, an electromagnetic switch attached to an end of the d.c. motor so that the plunger rod of the electromagnetic switch extends in the hollow armature shaft in a coaxial manner, an output rotary shaft arranged in alignment with the armature rotary shaft so as to be slidable in its axial direction and to be rotated by the armature rotary shaft by means of a planet gear speed reducing device and an overrunning clutch device, the output rotary shaft being provided with a pinion at its front end, wherein a carrier of the planet gear wheel speed-reducing device is formed integrally with clutch outer member of the overrunning clutch device; the carrier is supported by a first bearing mounted on the front end portion of the armature rotary shaft; and the clutch outer member is supported by a second bearing fitted to a clutch inner member at a position adjacent to the front end of a roller in the overrunning clutch device.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
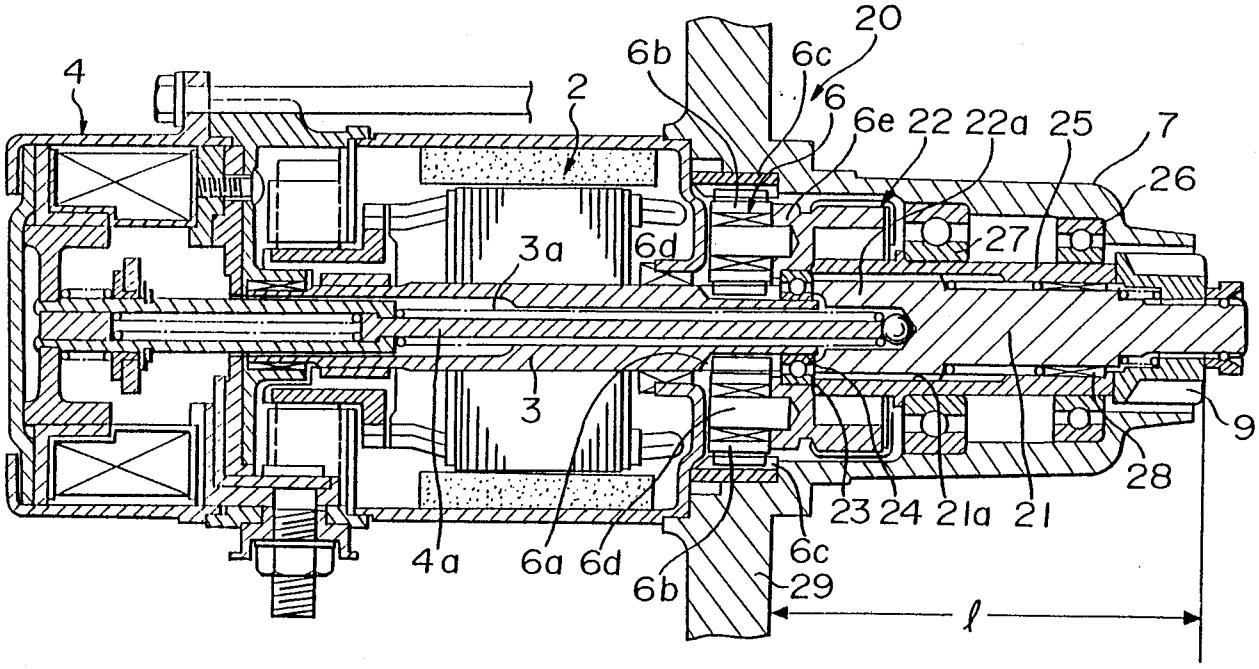
FIG. 1 is a longitudinal cross-sectional view of an embodiment of the coaxial type starter device according to the present invention.

Preferred embodiments of the present invention will be described in detail with refernece to the drawings. In FIG. 1, a reference numeral 20 designates a coaxial type starter device according to an embodiment of the present invention. In the starter device 20 as shown in FIG. 1, a rotating force of an armature rotary shaft 3 is transmitted to an output rotary shaft 21 by means of a planet gear wheel speed-reducing device 6 and an overrunning clutch device 22 in the same manner as the starter device described with reference to FIG. 3. The planet gear wheel speed reducing device 6 comprises a sun gear wheel **6*a* formed at the outer circumferential portion of the front end of the armature rotary shaft 3, an internal gear wheel 6*c* formed inside a bracket of the starter device 20, and a plurality of planet gear wheels 6*b* which are interlocked with both the sun gear wheel 6*a* and the internal gear wheel 6*c* and which are supported by a carrier 6*e* by means of respective pins 6*d***.

Figure 3:
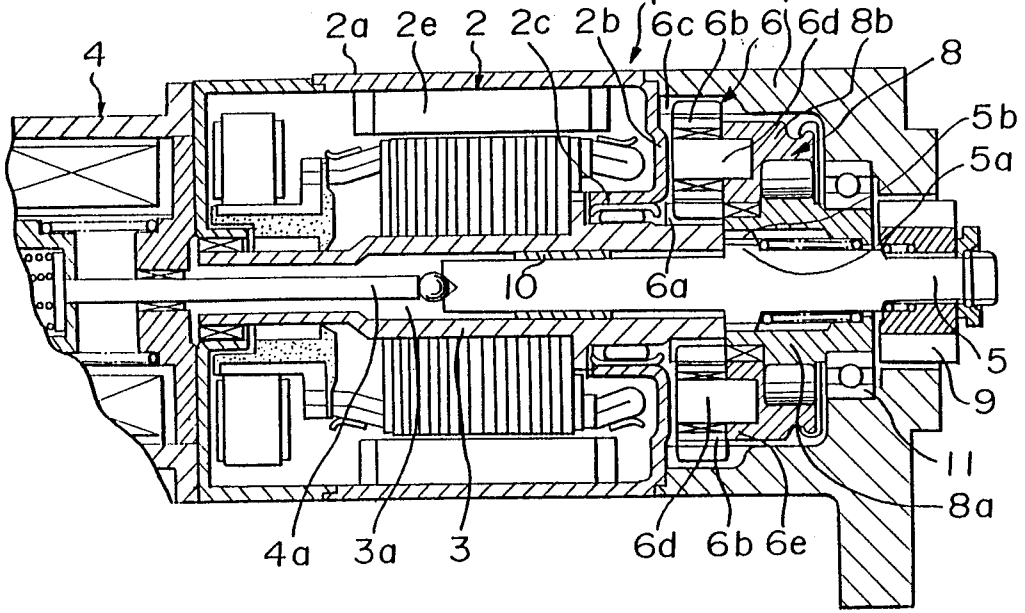
FIG. 3 is a longitudinal cross-sectional view partly broken of a conventional coaxial type starter device.

A ball bearing 23 is fitted to the inner circumferential portion of the carrier **6*e* of the planet gear wheel speed-reducing device 6, and the ball bearing 23 is fitted to a reduced diameter step portion which is formed at the outer circumferential portion of the front end of the armature rotary shaft so as to ajoin the sun gear wheel 6*a* formed in the rotary shaft 3, whereby the carrier 6*e* is supported by the armature rotary shaft 3 by means of the ball bearing 23. The construction that the carrier 6*e* is directly supported by the armature rotary shaft 3 by the ball bearing 23 provides the advantage as follows. Namely, in considering the relation between the sun gear wheel and the planet gear wheels, it is desirable that each of the planet gear wheels revolve in such a manner that the axial lines of revolution are always in coincidence with the axial line of the armature rotary shaft. However, as shown in FIG. 3 illustrating the conventional coaxial type starter device 1, when the carrier 6*e* is supported by a bearing at the rear end of the clutch inner member 8*e* of the overrunning clutch device 8, it is difficult to maintain the axial center of revolution of the carrier, i.e. the axial center of revolution of the planet gear wheels to a predetermined position when we condsider a state of engagement of the overrunning clutch 8 with the output rotary shaft 5 by means of a helical spline. However, with the construction that as shown in FIG. 1, the carrier 6*e* is directly supported by the armature rotary shaft 3 with the ball bearing 23, the axial center of revolution of the carrier 6*e* is completely in agreement with the axial center of the armature rotary shaft 3** when a problem of accuracy of machining is neglected.

The clutch inner member **22*a* of the overrunning clutch device 22 includes a cylindrical portion 25 which is formed integrally therewith and extends forwardly in the axial direction. The cylindrical portion 25 is supported by first and second bearings 26, 27 which are spaced apart in the axial direction of the cylindrical portion 25 so that the clutch inner member 22*a*** can be rotated around the axial center of the same.

The output rotary shaft 21 provided with a pinion 9 at its front end is disposed in the clutch inner member **22*a* (including the cylindrical portion 25) so as to be slidable in the axial direction. The rear end of the output rotary shaft 21 extends to a position to be in contact with the side surface of a ball bearing 23 but without penetrating in the armature rotary shaft 3 unlike the conventional device. Accordingly, a plunger rod 4***a* of the electromagnetic switch device 4, which extends in an inner passage 3*a* formed in the armature rotary shaft 3, is in contact with the rear end of the output rotary shaft 21 through a steel ball placed in a concave portion formed in the rear end of the output rotary shaft 21.

A helical spline is formed in the inner circumferential surface of the clutch inner member 22*a* so as to extend to the intermediate portion of the cylindrical portion 25, namely, between the two bearings 26, 27. On the other hand, relatively long helical spline teeth 21*a* are formed in the outer circumferential surface of the rear end of the output rotary shaft 21 along its axial direction so that the helical spline teeth 21 are interlocked with the helical spline formed in the inner circumferential surface of the clutch inner member 22*a* including the cylindrical portion 25. The output rotary shaft 21 is supported in a rotatably slidable manner by means of a bearing metal 28 which is fitted in the inner circumferential surface of the cylindrical portion 25, which corresponds to the position of the first bearing 26.

The operation of the coaxial type starter device of the above-mentioned embodiment will be described.

When the starter switch of an automobile is turned on, an electric current is fed to an excitation coil of the electromagnetic switch device 4, whereby the plunger rod 4*a* is moved on the right along the axial line of the armature rotary shaft 3 in FIG. 1 due to an electromagnetic force produced in the excitation coil. As a result, the output rotary shaft 21 is pushed and the pinion 9 provided at its front end is interlocked with the ring gear of the engine. At the same time, the movement of the plunger causes mutual contact of the movable and fixed contacts (not shown) so that a power source is connected to the d.c. motor 2 to thereby actuate the same. As a result, a rotating force caused by the armature rotary shaft 3 is transmitted to the clutch outer member 22*b* of the overrunning clutch device 22 while a rotating speed is reduced by the planet gear wheel speed reducing device. A torque of the clutch outer member 22 is transmitted to the clutch inner member 22*a* by means of cylindrical rollers. The rotating force of the clutch inner member 2*a* is transmitted to the output rotary shaft 21 by means of the helical spline, whereby the engine is started by the pinion 9 attached to the output rotary shaft 21.

After the engine has been started, the overrunning clutch device 22 prevents a reverse-rotating force from transmitting the engine to the d.c.motor, and at the same time, the output rotary shaft 21 and the plunger rod 4*a* extending from the electromagnetic switch device 4 ar returned to the original position by a return spring which is arranged at an appropriate position.

When the pinion 9 is brought into engagement with the ring gear during an idling operation and if an abnormal shock is applied to the pinion 9, the output rotary shaft 21 tends to deflect itself. However, since the output rotary shaft 21 is supported by the bearing metal 28 at its front part and the relatively long helical spline teeth 21*a* are formed in the outer circumferential surface of the rear part of the output rotary shaft 21 along the axial direction, the deflection of the output rotary shaft 21 is prohibited. Nevertheless even though the output rotary shat 21 is deflected by suffering a large shock or by the bearing metal 28 being greatly worn, the deflection of the clutch inner member 22 is not caused regardless of the deflection of the output rotary shaft 21 because the cylindrical portion 25 of the clutch inner member 22*a* is supported by the two bearings 26, 27 which are placed spaced apart in the axial direction of the clutch inner member 22*a*. Accordingly, the deflection of the planet gear wheel speed-reducing device 6 having the carrier 6*e* formed integrally with the clutch outer member 22*b* can be prevented to thereby avoid occurrence of breakage and generation of noises in the planet gear wheel 6*b*.

The following advantage is obtainable by the starter device in which the clutch inner member 22*a* of the overrunning clutch device 22 has the cylindrical portion 25 formed integrally therewith and extending forwardly and the cylindrical portion 25 is supported by the two bearings 26, 27 which are apart from each other in the axial direction.

Namely, it is unnecessary to support the rear end portion of the output rotary shaft 21 inserted in the inner passage 3*a* of the armature rotary shaft 3 by means of a bearing metal fitted to the inner circumferential surface of the hollow rotary shaft 3 as in the conventional starter device. It is because the clutch inner member 22*a* is supported by the two bearings which are spaced apart from each other in the axial direction, whereby there is no risk of deflection of the clutch inner member 22*a* even though the output rotary shaft 21 is more or less deflected. The output rotary shaft 21 can be prevented from deflection by forming relatively long helical spline teeth 21A and by disposing the bearing metal 28 at the front portion of the shaft 21.

Thus in accordance with the present invention, it is unnecessary to support the rear end portion of the output rotary shaft 21 which is inserted in the inner passage of the armature rotary shaft 3. Therefore, the outer diameter of the armature rotary shaft 3, especially, the outer diameter of the sun gear wheel 6*a*, can be small, with the consequence that the planet gear wheel speed-reducing device 6 can be small-sized. This means that the thickness of the bracket surrounding the planet gear wheel speed-reducing device 6 can be sufficiently increased, so that a fitting portion 29 to be attached to the engine can be formed. Further, the length l between the fitting portion 29 and the pinion which has come to the retracting position can be elongated. Accordingly, the starter device of the present invention is applicable to an engine having a ring gear which is not so extended from the engine.

As described above, in accordance with the above-mentioned embodiment of the coaxial type starter device of the present invention, function of the starter device is not influenced even when the output rotary shaft is deflected by receiving a great shock due to an abnormal engagement of the pinion with the ring gear of the engine, and therefore breakage in the gear wheels of the planet gear wheel speed-reducing device and generation of abnormal sounds from the speed-reducing device can be prevented.

A second embodiment of the coaxial type starter device according to the present invention will be described.

Figure 2:
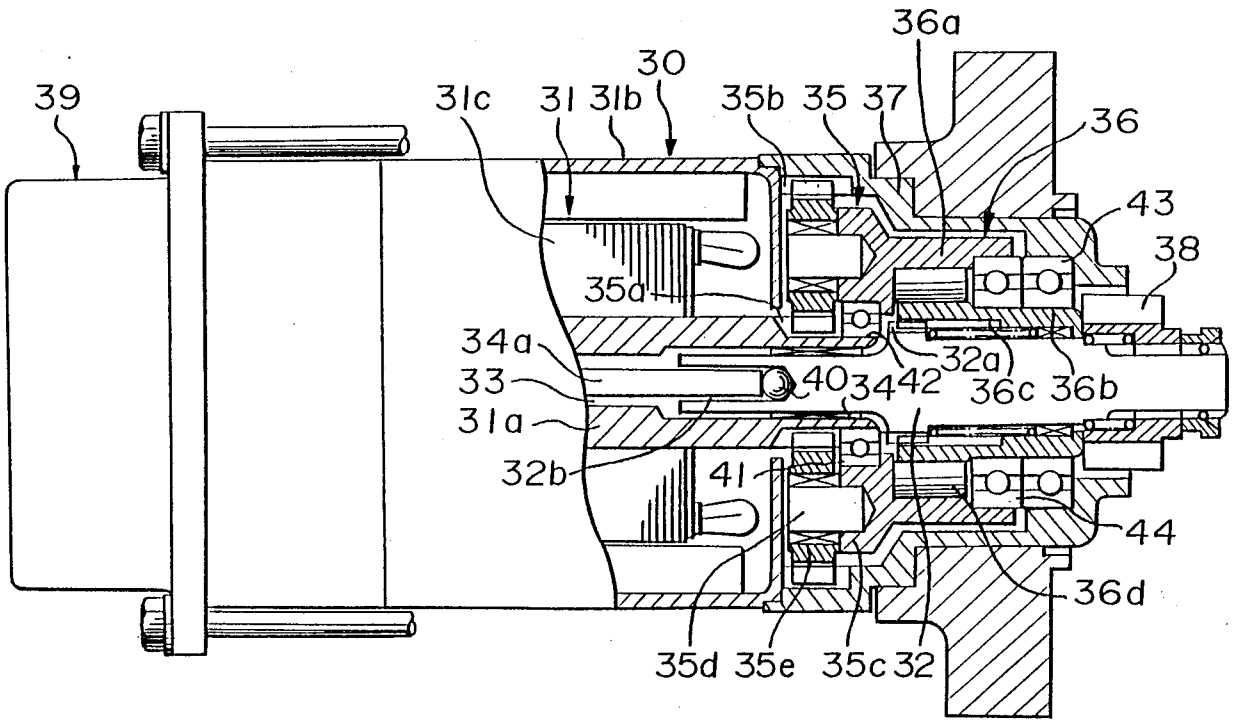
FIG. 2 is a front view partly cross-sectioned in the longitudinal direction of a second embodiment of the coaxial type starter device of the present invention.

In FIG. 2, a reference numeral 30 designates in general a coaxial type starter device. The device 30 comprises a d.c. motor 31 having a york 31*b* which functions as a bracket of the device and an armature rotary shaft 31*a* in a tubular form which is disposed on the axial center line of the york 31*b*. An armature core 31*c* is firmly attached to the outer circumference of the hollow armature rotary shaft 31*a* by forcibly fitting the armature core. An output rotary shaft 32 is arranged at the front side (on the right in FIG. 2) of the d.c. motor 31 so as to be in alignment with the axial line of the armature rotary shaft 31*a*. The rear portion of the output rotary shaft 32 is inserted in the inner passage 33 of the armature rotary shaft 31*a* and is supported slidably in the axial direction by means of a sleeve bearing 34 which is disposed between the inner circumferential surface Of the inner passage 33 and the outer circumferential surface of the output rotary shaft 32.

A rotating force produced by the armature rotary shaft 31*a* is transmitted to the output rotary shaft 32 by means of a planet gear wheel speed-reducing device 35 and an overrunning clutch device 36. Namely, the planet gear wheel speed-reducing device 35 is constituted by a sun gear wheel 35*a* formed in the outer circumferential portion of an end of the armature rotary shaft 31*a*, an internal gear wheel 35*b* formed in a front bracket 37, i.e. the bracket of the starter device 30, and a plurality of planet gear wheels 35*e* which are interlocked with both the sun gear wheel 35*a* and the internal gear wheel 35*b* and which are supported by a carrier 35*c* in the overrunning clutch device 36, the carrier 35*c* being formed integrally with a clutch outer member 36*a* in the overrunning clutch device 36. A herical spline 36*c* is formed in the inner circumferential surface of the clutch inner member 36*b* of the overrunning clutch device 36 so that it is interlocked with a herical spline 32*a* formed in the outer circumferential surface of the output rotary shaft 32, whereby the output rotary shaft 32 is slidable in the axial direction while it receives a rotating force from the clutch inner member 36*b*. A pinion 38 is attachecd to the end portion of extention of the ouptut rotary shaft 32 from the front bracket 37 so as to be engaged with a ring gear proviced in an engine.

On the other hand, an electromagnetic switch device 39 is connected to the rear end (on the left in FIG. 2) of the d.c. motor 31. Function of the electromagnetic switch device 39 is same as the coaxial type starter device as shown in FIG. 3. Namely, it is actuated by turning on a key switch in the automobile, and an electromagnetic force produced therein moves a plunger rod 34*a* to thereby push the output rotary shaft 32 so that the pinion 38 is interlocked with the ring gear of the engine, and at the same time a power source is connected to the d.c. motor 31.

In the coaxial type starter device of the present invention, a consturuction to cause the engagement of the pinion with the ring gear of the engine by the movement of the plunger rod of the electromagnetic switch will be described.

The plunger rod 34*a* operatively connected to the plunger (not shown) of the electromagnetic switch 39, which is so disposed as to be in alignment with the armature rotary shaft 31*a* of the d.c. motor 31, is inserted in the inner passage 33 of the armature rotary shaft 31*a*, and the free end of the rod 34*a* is in contact with the bottom wall of a recess 32*b* formed in an end of the output rotary shaft 32 through a steel ball 40.

A ball bearing 41 is fitted to the outer circumferential portion of a reduced diameter step portion 42 which is formed at the front end of the armature rotary shaft 31*a* so as to ajoin the sun gear wheel 35*a* which is also formed in the rotary shaft 31*a*, and the carrier 35*c* of the planet gear wheel speed-reducing device 35 is fitted to the outer circumferential portion of the ball bearing 41. Accordingly, movement of the carrier 35 in the radial direction is entirely limited by the ball bearing 41, and there is no possibility of causing deflection of the carrier 35*c* with respect to the axial line of the armature rotary shaft 31*a*.

The clutch inner member 36*b* of the overruning clutch device 36 has the front end portion extending toward the pinion, and a bearing 43 is fitted to the outer circumferential portion of the extension of the clutch inner member 36*b*, the bearing 43 being in turn supported by the front bracket 37. Accordingly, the axial center of revolution of each of the planet gear wheels 35*e*, the axial center line of revolution of the overrunning clutch 36 and the axial line of the armature rotary shaft 31*a* are aligned to thereby avoid the deflection of axial line of the device as a whole.

Further, in the coaxial type starter device 30 of the second embodiment, the clutch outer member 36*a* of the overrunning clutch device 36 has the front end portion supported by a ball bearing 44 which is fitted to the clutch inner member 36*b*, the ball bearing 44 being adjacent to a roller 36*d* disposed between the clutch inner member 36*b* and the clutch outer member 36*a*. With such construction, the clutch inner member 36*b* is stably supported by the front bracket 37 by means of the bearing 43, and therefore, the front end portion of the armature rotary shaft 31*a* is supported by means of the carrier 35*c* and the bearing 44 in a stable manner.

On the outer circumferential surface of the outer race of the ball bearing 44 which is disposed between the clutch inner member 36*b* and the clutch outer member 36*a*, rubber or resinous material is coated by, for instance, a baking method, whereby grease is prevented from flowing from the inside of a clutch mechanism. Such construction that the ball bearing 44 is disposed between the clutch inner member 36*b* and the clutch outer member 36*a* at the front end side of the overrunning clutch device 36 and in visinity of the roller 36, unnecessitates to used a cover which is required in a conventional starter device. Accordingly, a caulking operation for attaching the cover and an operation for forming a groove in the outer circumferential portion of the clutch outer member are not required.

In the second embodiment of the present invention, a bearing supporting section in the intermediate bracket which supports the armature rotary shaft can be eliminated. As a result, a relatively long magnetic poles can be attached to the inner circumferential surface of the york to thereby render the d.c. motor to be high performance and to eliminate eccentricity in the overruning clutch device and the planet gear wheel speedreducing device to the armature rotary shaft. Thus, by eliminating the eccentricity, a stable operation can be assured.

Obviously, numerous modifications and variations of the present invention are possible in light of the above teachings. It is therefore to be understood that within the scope of the appended claims, the invention may be practiced otherwise than as specifically described herein.

What is claimed is:

1. A coaxial type starter device which comprises:

a d.c. motor having a hollow armature rotary shaft, an electromagnetic switch attached to an end of said d.c. motor so that a plunger rod of said electromagnetic switch extends in said hollow armature shaft in a coaxial manner, an output rotary shaft arranged in alignment with said armature rotary shaft so as to be slidable in its axial direction and to be rotated by said armature rotary shaft by means of a planet gear wheel speed-reducing device and an overrunning clutch device, said output rotary shaft being provided with a pinion at its front end, wherein said overrunning clutch device has a clutch inner member which is provided with a cylindrical portion formed integrally therewith and extended forwardly; is rotatably supported by means of first and second bearings spaced apart in the axial direction so that they bear said cylindrical portion; and has a helical spline at the inner circumferential surface so as to be engaged with a helical spline formed at the outer circumferential surface of said output rotary shaft inserted in the clutch inner member so that a rotating force by said armature rotary shaft is transmitted to the same.

2. The coaxial type starter device according to claim 1, wherein said first and second bearings are disposed between the outer circumferential surface of said cylindrical body and the inner wall of a bracket which surrounds said output rotary shaft.

3. The coaxial type starter device according to claim 1, wherein said helical splines of said clutch inner member and said output rotary shaft are formed at positions near said armature rotary shaft and a bearing metal is disposed at the front end portion between said cylindrical body and said output rotary shaft.

4. A coaxial type starter device which comprises:

a d.c. motor having a hollow armature rotary shaft, an electromagnetic switch attached to an end of said d.c. motor so that the plunger rod of said electromagnetic switch extends in said hollow armature shaft in a coaxial manner, an output rotary shaft arranged in alignment with said armature rotary shaft so as to be slidable in its axial direction and to be rotated by said armature rotary shaft by means of a planet gear wheel speed-reducing device and an overrunning clutch device, said output rotary shaft being provided with a pinion at its front end, wherein a carrier of said planet gear wheel speedreducing device is formed integrally with a clutch outer member of said overrunning clutch device; said carrier is supported by a first bearing mounted on the front end portion of said armature rotary shaft; and said clutch outer member is supported by a second bearing fitted to a clutch inner member at a position adjacent to the front end of a roller in said overrunning clutch device.

5. The coaxial type starter device according to claim 4, wherein a third bearing is provided near said second bearing and between the outer circumferential surface of said clutch inner member and the inner wall of a front bracket.

* * * * *